US005324208A

United States Patent [19]

Kodama et al.

[11] Patent Number: 5,324,208

[45] Date of Patent: Jun. 28, 1994

[54] WATERPROOF CONNECTOR

[75] Inventors: Shinji Kodama; Tetsuo Kato, both of Shizuoka, Japan

[73] Assignee: Yazaki Corporation, Tokyo, Japan

[21] Appl. No.: 77,990

[22] Filed: Jun. 18, 1993

[30] Foreign Application Priority Data

Jun. 22, 1992 [JP] Japan ..... 4-162709

[51] Int. Cl.[5] ..... H01R 13/00

[52] U.S. Cl. ..... 439/271

[58] Field of Search ..... 439/271-283

[56] References Cited

U.S. PATENT DOCUMENTS 4,917,620 4/1990 Samejima et al. ..... 439/271
5,083,933 1/1992 Colleran et al. ..... 439/271
5,116,236 5/1992 Colleran et al. ..... 439/271

FOREIGN PATENT DOCUMENTS 57-10462 3/1982 Japan .

*Primary Examiner*—Joseph H. McGlynn
*Attorney, Agent, or Firm*—Armstrong, Westerman, Hattori, McLeland & Naughton

[57] ABSTRACT

The waterproof connector in which an O-ring is attached to a front end of a connector housing by a supporting ring, and the O-ring is prevented from falling from a connector housing even the supporting ring is in a preliminarily locking state. The waterproof connector according to the present invention comprises: a connector housing with projections at an end thereof; a plurality of terminal accommodating cavities with resilient locking pieces in the connector housing for accommodating terminals which are inserted in the terminal accommodating cavities; a packing attached to the end portion of the connector housing; and a packing support with spacers projecting on a wall thereof which opposes the connector housing, the packing support further having accommodating concave portions for accommodating the projections of the connector housing, wherein the spacers of the packing support allow the resilient locking pieces of the terminal accommodating cavities to resiliently deflect in a preliminarily locked state and prevent the resilient locking pieces from resiliently deflecting in a fully locked state, and the packing support which is situated apart from the packing in the preliminarily locked state, becomes in contact with the packing in the fully locked state, and the accommodating concave portions of the packing support receives the projections therein.

2 Claims, 5 Drawing Sheets

WATERPROOF CONNECTOR

BACKGROUND OF THE INVENTION

1. Field of the Invention

The present invention relates to a waterproof connector, and more particularly to a waterproof connector mainly used for connecting wire harnesses in a vehicle.

2. Description of the Prior Art

FIGS. 7 to 9 show a conventional waterproof connector used for a vehicle, which is disclosed in Japanese Utility Model Publication (Examined) No. Showa 57-10462. In the conventional connector, an end portion C with small diameter is formed at a front end of a waterproof male connector. A channel is formed by a shoulder b and a supporting ring e to fix an O-ring to the portion c. Locking arms f extend in the axial direction of the connector from a wall of the supporting ring e to engage projections g in the connector housing a.

With the structure described above, the locking arms f of the supporting ring e are used as spacers also, which are inserted in space where well-known resilient locking pieces for locking terminals (not shown) can be deflected, so that the locking arms f prevent the resilient locking piece from being deflected to secure the locking of the terminal. Before inserting the terminal, it is required to maintain the supporting ring e at a preliminary locking position apart from the portion c to prevent the locking arms f as spacers from abutting the resilient locking pieces. In this case, there is a fear of dropping the O-ring from the portion c with small diameter since no support is provided for the supporting ring e.

SUMMARY OF THE INVENTION

The present invention has been accomplished to eliminate the drawbacks described above and the object thereof is to provide a waterproof connector in which an O-ring is attached to a front end of a connector housing by a supporting ring, and the O-ring is prevented from falling from a connector housing even the supporting ring is in a preliminarily locking state where it is apart from the O-ring.

The waterproof connector according to the present invention comprises: a connector housing with projections at an end thereof; a plurality of terminal accommodating cavities with resilient locking pieces in the connector housing for accommodating terminals which are inserted in the terminal accommodating cavities; a packing attached to the end portion of the connector housing; and a packing support with spacers projecting on a wall thereof which opposes the connector housing, the packing support further having accommodating concave portions for accommodating the projections of the connector housing, wherein the spacers of the packing support allow the resilient locking pieces of the terminal accommodating cavities to resiliently deflect in a preliminarily locked state and prevent the resilient locking pieces from resiliently deflecting in a fully locked state, and the packing support, which is situated apart from the packing in the preliminarily locked state, becomes in contact with the packing in the fully locked state, and the accommodating concave portions of the packing support receives the projections therein.

BRIEF DESCRIPTION OF THE DRAWINGS

The present invention will be more apparent from the ensuring description with reference to the accompanying drawing wherein.

DETAILED DESCRIPTION OF PREFERRED EMBODIMENTS

Figure 1:
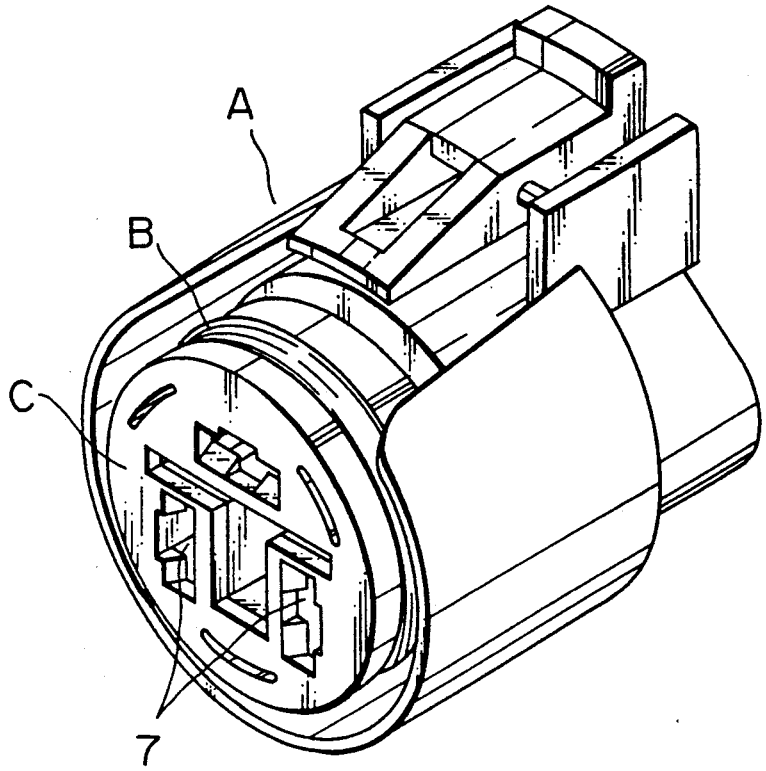
FIG. 1 is a perspective view of a waterproof connector according to an embodiment of the present invention.
Figure 9:
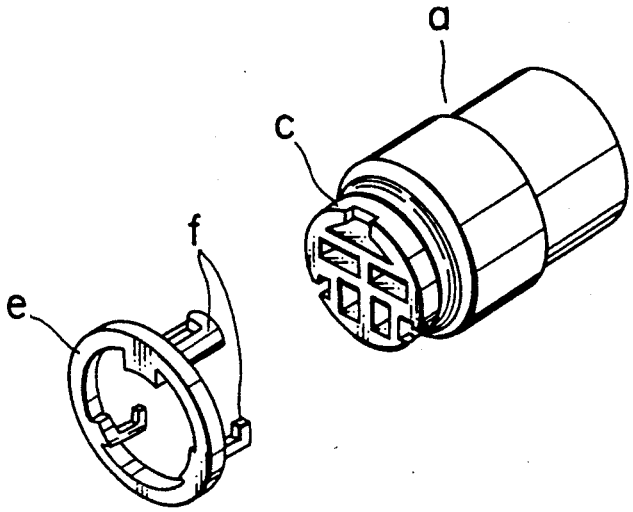
FIG. 9 PRIOR ART
FIG. 9 is an exploded perspective view of the conventional waterproof connector shown in FIG. 7.
Figure 2:
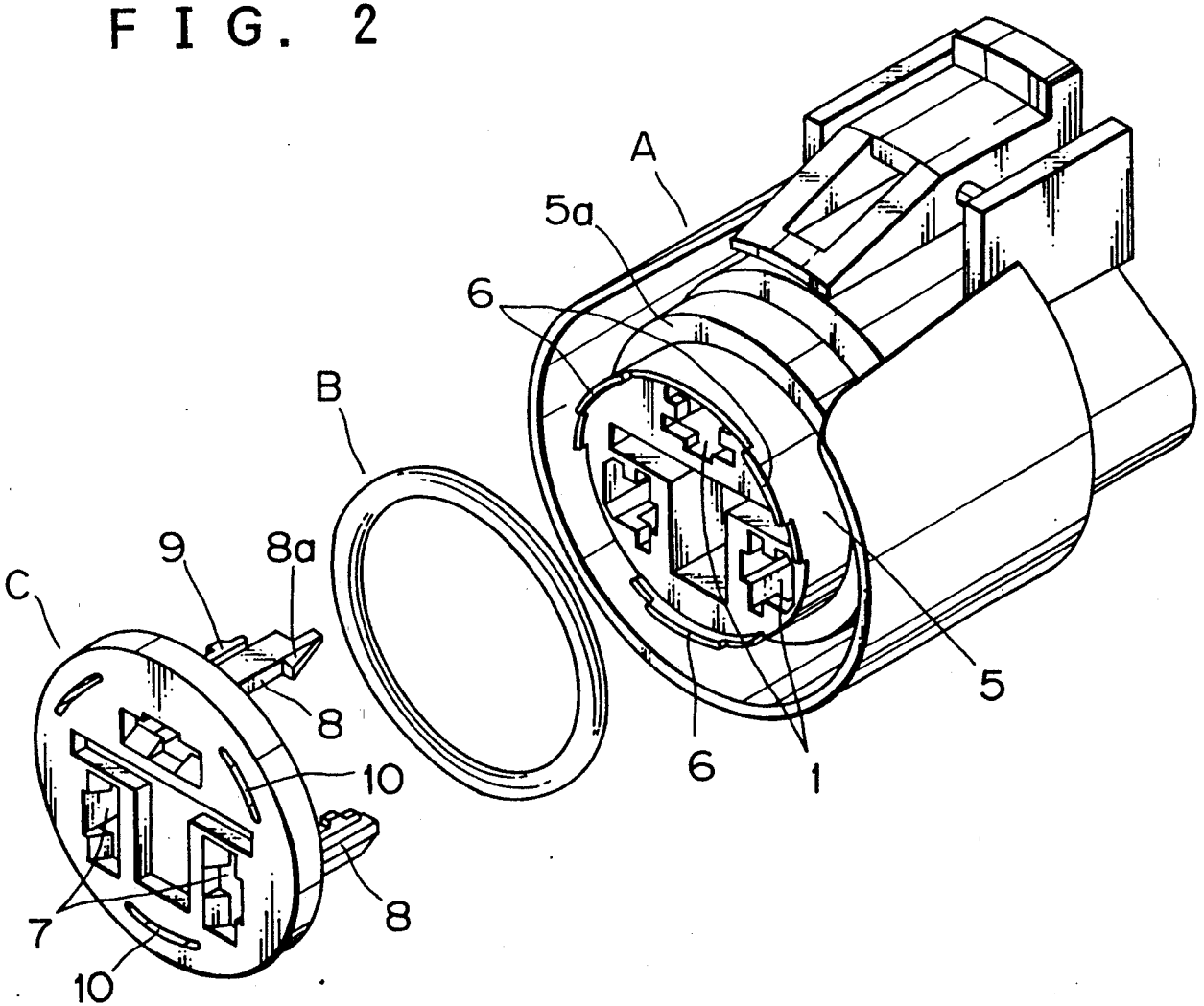
FIG. 2 is an exploded perspective view of the waterproof connector shown in FIG. 1.

In FIG. 1, reference symbol A shows a male connector housing; B shows a packing; and C a packing support. The connector housing A is provided with a plurality of terminal accommodating cavities 1 extending in the axial direction of the connector housing A. The plurality of terminal cavities are provided with resilient arms 2, preliminary locking arms 3, and main locking arms 4 for terminals D, as illustrated in FIGS. 4, 5, and 6.

A plurality of projections 6 are formed on an end portion 5 of the male connector housing A with regular intervals in the circumferential direction. A ring-like packing B is inserted in the end portion 5.

A disk-shaped packing support C is provided with a plurality of insertion holes corresponding to the positions of the terminal accommodating cavities 1. Further, a plurality sets of resilient spacer 8 and resilient main locking piece 9 are formed on the packing support C. The resilient spacer 8 is simultaneously used as a preliminarily locking pieces, which pass through the terminal accommodating cavities 1. Accommodating concave portions 10 are formed on the packing support C to accommodate the projections 6. In another embodiment, in place of the projections, a projecting end without being divided into the plurality of pieces may be formed at an end of the portion 5, and the projecting end may be accommodated in another round accommodating cavity on the packing support.

Figure 3:
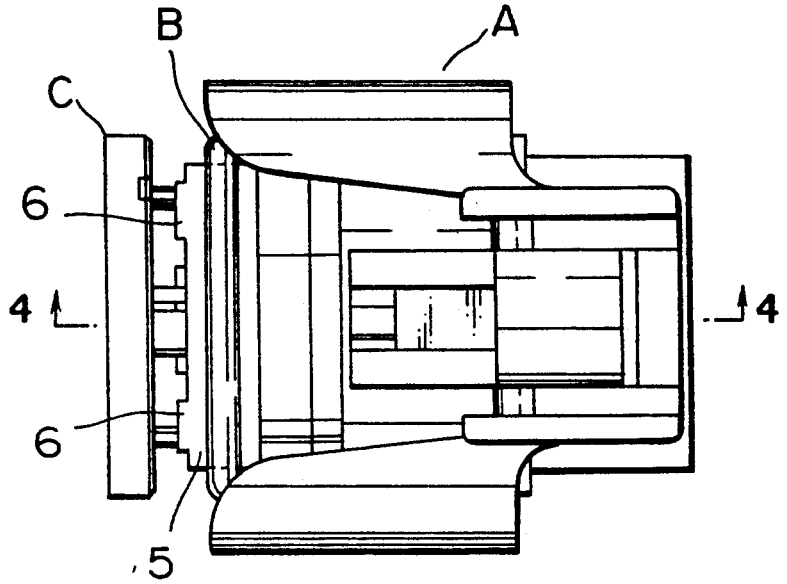
FIG. 3 is a plan view of a packing support in a preliminarily locked state according to the present invention.
Figure 4:
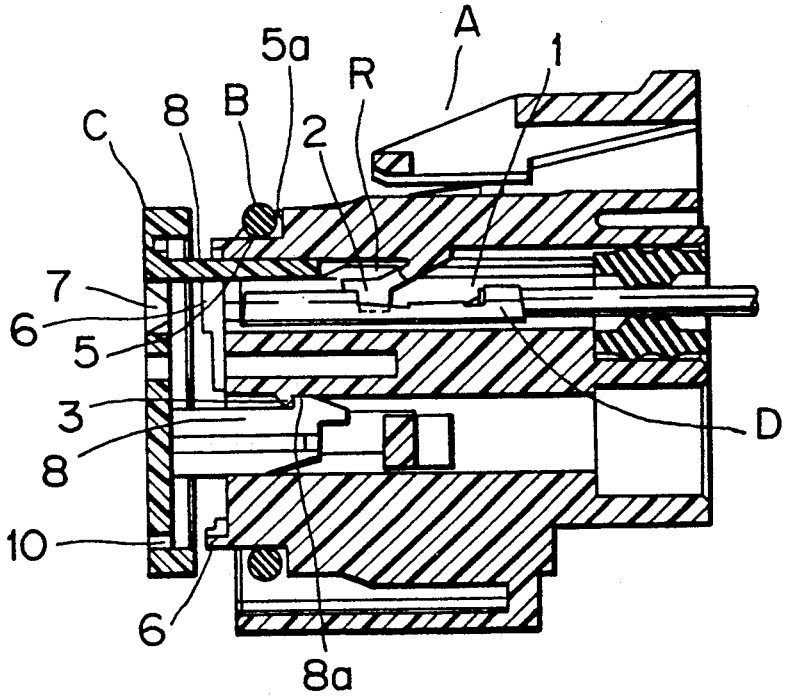
FIG. 4 shows a cross-sectional view of the waterproof connector taken along the line X—X in FIG. 3.
Figure 5:
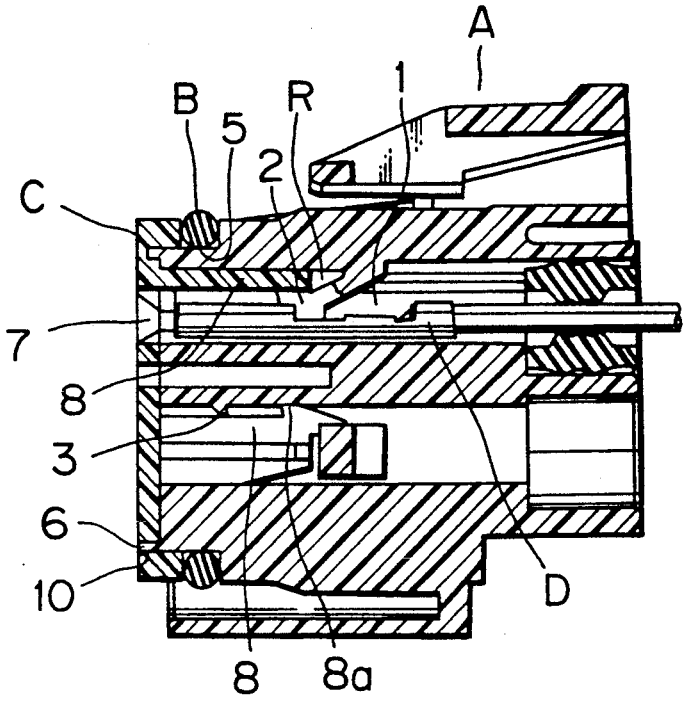
FIG. 5 is a cross-sectional view of the waterproof connector in a fully locked state.
Figure 6:
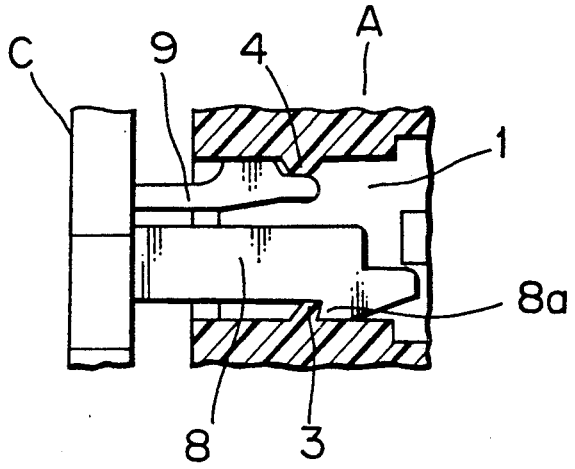
FIG. 6 shows a primarily enlarged view of the waterproof connector of the present invention.
Figure 7:
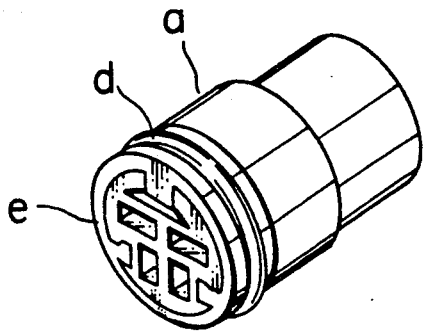
FIG. 7 PRIOR ART
FIG. 7 is a perspective view of a conventional waterproof connector.
Figure 8:
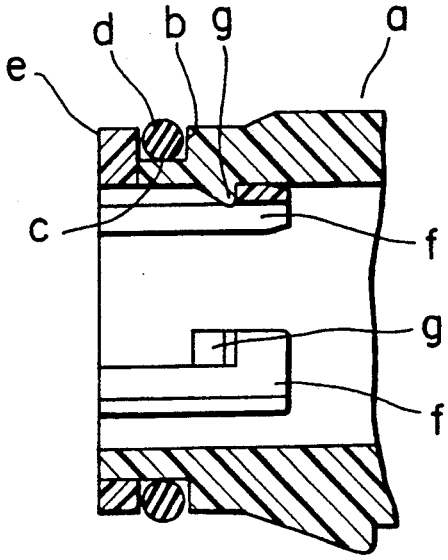
FIG. 8 PRIOR ART
FIG. 8 is a primarily enlarged view of the conventional waterproof connector shown in FIG. 7.

With the structure described above, the packing support C is maintained in a preliminarily locked state against the male connector housing A in which the ring-like packing B is attached to the end portion 5 thereof, as shown in FIGS. 3, 4, and 6. In the preliminarily locked state, a projection 8*a* of the spacer 8 engages the preliminary locking projection 3 on the terminal accommodating cavity to prevent the packing support C from being disconnected from the male connector housing A. In this case, the piece 8 is positioned out of a space R behind the resilient piece 2 where the resilient piece 2 can be deflected, so that the terminal D can be inserted into the cavity with deflecting the resilient piece 2 through the space R. As a result, the terminal D is locked to the connector housing A with the resilient pieces 2.

In the preliminarily locked state, the packing support C does not support the ring-like packing B but prevents the packing B from falling from the portion 5 due to the existence of the projection 6.

The packing support C is pushed under the condition that the terminal D is inserted to change the position of the connector from the preliminarily locked state, shown in FIG. 4, to the fully locked state, in which the main locking piece 9 engages the main locking projection 4. In the fully locked condition, the spacer 8 proceeds into the space R and prevents the resilient piece 2 from being deflected to maintain the locking of the terminal D. The packing support C becomes in contact with the packing B to fix it to the end portion 5, and the projections 6 are accommodated in the accommodating concave portions 10 as illustrated in FIG. 5.

As described above, the packing is mounted to the front end portion with projections of the connector housing, and the packing support is locked to the connector housing in two steps such as the preliminarily locked state and the fully locked state. Further, the spacers attached to the packing support allow the resilient locking pieces of the terminal accommodating cavities to deflect in the preliminarily locked condition and the spacers prevent the resilient locking pieces from deflecting in the fully locked state. The packing support apart from the packing in the preliminarily locked state becomes in contact with the packing in the fully locked state and the accommodating concave portions of the packing support receive the projeotions. As a result, the packing is prevented from falling from the comparatively narrow front end portion by the projections in the preliminarily locked state. In addition, in the fully locked state, the projections are accommodated in the accommodating concave portions of the packing support to directly support the packing.

What is claimed is:

1. A waterproof connector comprising:

a connector housing with projections at an end thereof;

a plurality of terminal accommodating cavities with resilient locking pieces in the connector housing for accommodating terminals which are inserted in the terminal accommodating cavities;

a packing attached to the end portion of the connector housing; and a packing support with spacers projecting on a wall thereof which opposes the connector housing, said packing support further having accommodating concave portions for accommodating the projections of the connector housing, wherein the spacers of the packing support allow the resilient locking pieces of the terminal accommodating cavities to resiliently deflect in a preliminarily locked state and prevent the resilient locking pieces from resiliently deflecting in a fully locked state, and the packing support which is situated apart from the packing in the preliminarily locked state, becomes in contact with the packing in the fully locked state, and the accommodating concave portions of the packing support receives the projections therein.

2. A waterproof connector as claimed in claim 1, wherein said projections of the connector housing are formed such that substantially round end portion of the connector housing are divided with regular intervals in the circumferential direction of the end portion, and the accommodating concave portions include slits which pass through the packing support for accommodating the projections.

* * * * *